United States Patent [19]

Skoruppa

[11] Patent Number: 4,887,673

[45] Date of Patent: Dec. 19, 1989

[54] TECHNIQUE FOR COMPLETING SHALLOW WELLS WITH TENSION PACKER

[76] Inventor: Thomas S. Skoruppa, 11021 Mulholland, Corpus Christi, Tex. 78410

[21] Appl. No.: 152,250

[22] Filed: Feb. 4, 1988

[51] Int. Cl.[4] ..... E21B 19/10

[52] U.S. Cl. ..... 166/382; 175/423; 188/67; 285/144

[58] Field of Search ..... 166/380, 382; 175/423; 188/67; 285/144, 145, 146, 147, 148

[56] References Cited

U.S. PATENT DOCUMENTS

| | | | |
|---|---|---|---|
| 1,502,628 | 7/1924 | Hanna | 175/423 |
| 1,579,648 | 4/1926 | Crickmer | 285/147 |
| 1,650,074 | 11/1927 | Kammerdiner . | |
| 1,708,645 | 4/1929 | Wright . | |
| 1,874,440 | 8/1932 | Bush | 175/423 |
| 1,986,283 | 1/1935 | Penick et al. . | |
| 2,507,246 | 5/1950 | Davidson et al. . | |
| 2,712,455 | 7/1955 | Neilon . | |
| 3,330,354 | 7/1967 | Chamblee . | |
| 4,279,308 | 7/1981 | Gray et al. | 285/141 X |

FOREIGN PATENT DOCUMENTS

| | | | |
|---|---|---|---|
| 966531 | 8/1957 | Fed. Rep. of Germany | 175/423 |

OTHER PUBLICATIONS

TRW Mission Catalog C900, Jul: 1984.

Foster Oilfield Equipment Co. catalog FOEC 0286, Feb. 1986.

*Primary Examiner*—William P. Neuder

*Attorney, Agent, or Firm*—G. Turner Moller

[57] ABSTRACT

A bowl-slip assembly is used to complete shallow wells having a tension set hold down device such as a packer or tubing anchor. The bowl includes a trap door which is opened to allow the bowl to pass around the tubing string and rest on an underlying well head support, such as a tubing head. The trap door is closed and a short set of slips placed to receive the load of the tubing string and transfer it to the tubing head at a time when it is necessary to attach a Christmas tree to the tubing string and tubing head. The trap door bowl and slips are easily installed and removed and require a minimum clearance between the top of the tubing head flange and the bottom flange of the Christmas tree.

20 Claims, 2 Drawing Sheets

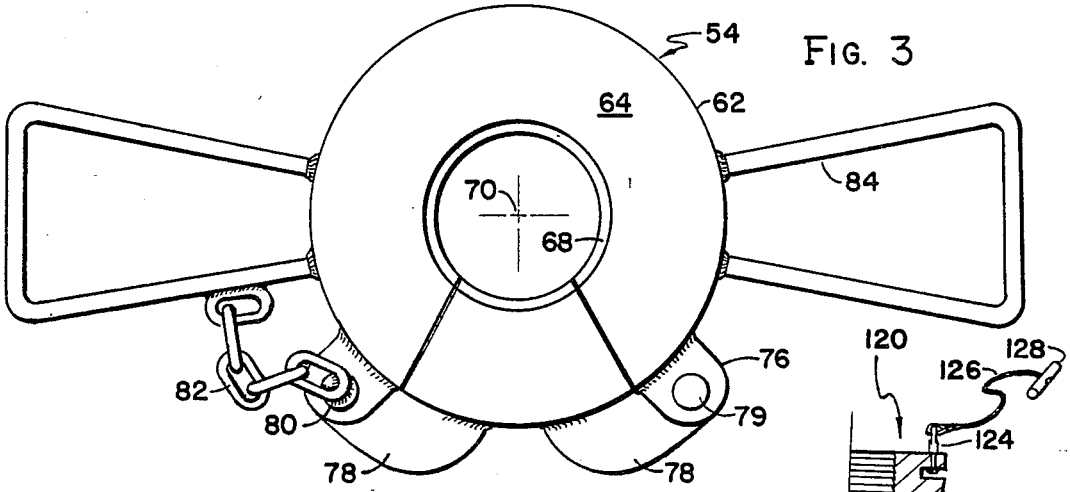
FIG. 3
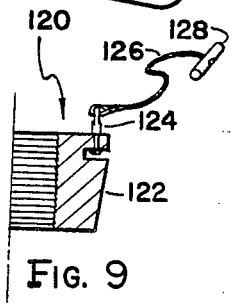
FIG. 9
FIG. 5
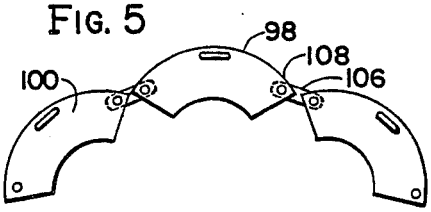
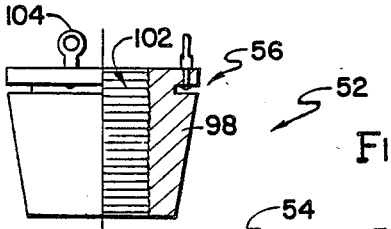
FIG. 4
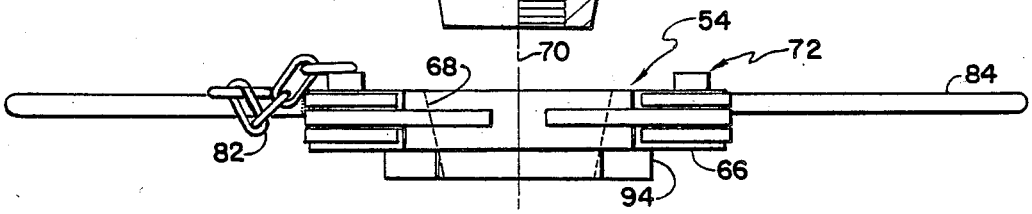
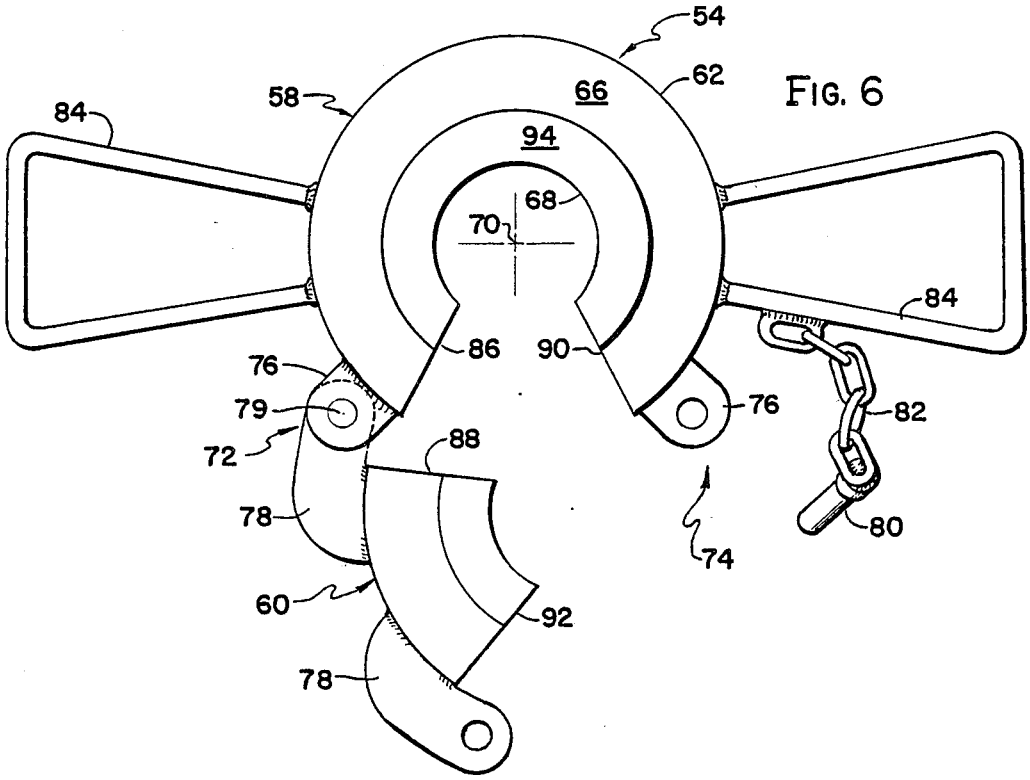
FIG. 6

TECHNIQUE FOR COMPLETING SHALLOW WELLS WITH TENSION PACKER

This invention relates to a method and apparatus for completing a shallow well using a tension held packer and more particularly to the provision of a novel bowl and slips assembly for suspending a tubing string in the well head of the well while the Christmas tree is attached to the tubing string.

Very shallow gas wells are presently typically completed by cementing a string of $2\frac{7}{8}''$ tubing in the bore hole. On the other hand, very shallow oil wells or water disposal wells are presently completed by cementing a string of casing, usually $4\frac{1}{2}''$ O.D. or $5\frac{1}{2}''$ O.D. in the bore hole, and then running a string of tubing, usually $2\frac{3}{8}''$ O.D. or $2\frac{7}{8}''$ O.D., inside the casing string. Older wells may have been completed with larger size casing strings with tubing inside them. This invention relates to shallow wells in which casing is cemented in the bore hole and tubing is placed inside the casing string.

Most wells of this type include a tubing hold down device such as a packer or, in the case of many oil wells, a tubing anchor on the bottom of the tubing string. These hold down devices act to hold the tubing string in a generally straight, centrally located position inside the casing string. It is desirable in most shallow wells to use a tension held packer or tubing anchor, i.e. a packer or tubing anchor which is set and held in place by pulling upwardly on the tubing string. Such packers are well known in the art and are commercially available as a Baker Model AD-1, Halliburton Model R-4, Guiberson Model Unipacker 6 or Otis Permalatch. The most common tension held tubing anchor is a Baker Model B-2.

Although other types of packers and tubing anchors are commercially available, tension held packers and tubing anchors are preferred for shallow well situations for a variety of reasons. Compression set packers are not suitable in very shallow well situations because there is insufficient weight in the short tubing string to set the packer. Hydraulically set packers are not preferred because they are much more expensive than tension set packers.

There is, however, a problem in using tension set packers or tubing anchors in very shallow wells as may best be explained by reference to FIGS. 1 and 2 where a shallow well 10 comprises a bore hole 12 extending into the earth and having a casing string 14 cemented therein by a cement sheath 16. Although well head assemblies vary widely, FIGS. 1 and 2 illustrate a typical modern situation where a conventional casing head or bradenhead 18 is attached to the casing string 14 by the provision of a coupling 20 and provides a flange 22 to which a conventional tubing head 24 has been secured by flange bolts 26. As will become more fully apparent hereinafter, the well 10 is in the process of being completed, during which a pressure control assembly 28, known as a tree or Christmas tree, will be attached to the tubing head 24. A tubing string 30 is connected to a tension held packer or tubing anchor 32 near the bottom of the well 10. Because the well 10 is shallow, the tubing string 30 is short and does not stretch much when pulled upon by a pup joint 34 threaded into the uppermost tubing joint 36 and attached to the travelling block 37 of the workover or completion rig (not shown) used to complete the well 10. The pup joint 34 is connected to the uppermost tubing joint 36 by a conventional tubing connection 38 comprising an externally upset threaded pin 40 on the uppermost tubing joint 36, a collar 42 and an externally upset threaded pin 44 on the pup joint 34.

The tubing string 30 and packer 32 are run into the well 10 by using a conventional set of hydraulically operated tubing slips 48 which rest on the tubing head 28. The packer or anchor 32 is set at a location where the bottom of the upset 40 is slightly below the upper tubing head flange 46 so the tree 28 will fit properly onto the tubing head 24. At this time, the tubing string 30 has to be suspended from the tubing head 24 so the pup joint 34 can be removed and the tree 28 attached to the uppermost tubing joint 36. To do this, the tubing string 30 has to be stretched enough to get the upset collar and pin connection 38 substantially above the top of the upper tubing head flange 46 so the slips 48 can grasp the tubing string 36 below the upset 40 and suspend the tubing string 36 from the tubing head 24. Because standard rig slips 48 are fairly tall, the bottom of the upset 40 must be at least 18" above the flange 46.

In shallow wells, the tubing string 30 cannot usually be stretched enough to pull the upset 40 above the slips 48 without shearing the pins (not shown) in the packer 32. If the tubing string 30 is long enough or one is fortunate in some respect, there is sufficient room to set the slips 48 below the upset 40 and support the tubing string 30 on the tubing head 24. The pup joint 34 and collar 42 are then removed and the tree 28 is screwed onto the upper threaded upset pin 40. The travelling block 37 of the rig is then attached to the tree assembly 28 and raised thereby taking the load off the slips 48. An attempt is then made to get the slips 48 off the tubing head 24 and one of three things happens: (1) if the slips 48 come out, the distance 50 is very large and the stretch goes out of the tubing string 30 when the tree 28 is ultimately lowered—too much tension is consequently lost whereby the packer or anchor 32 doesn't hold; (2) the slips 48 won't come out of the tubing head 24 because the distance 50 is too short; or (3) the slips 48 just barely come out and there is just barely enough tension left in the tubing string 30 to hold the packer 32.

For example, if the well 10 is such that the packer 32 is at 2000', pulling 40,000# on the pup joint 34 stretches a $2\frac{7}{8}''$ tubing string about 22", which is just barely sufficient to place the slips 48 in the tubing head 24 as shown in FIG. 1 and remove them as suggested in FIG. 2 while retaining some tension in the packer or anchor 32. Thus, it is difficult to install tension held tubing hold down devices at depths above 2000'. One might think you could pull harder on the tubing string 30 and thus stretch it further. This won't usually work because the packer or anchor 32 has shear pins in it which are designed to shear at 40,000#.

In response to this difficulty, the present invention incorporates a trap door bowl which is opened and moved around the tubing string when the tubing string is suspended from the pup joint held by the travelling block of the rig. The trap door is closed and the bowl seats on the existing tubing head or other support. Instead of having a long slightly tapered seating surface characteristic of conventional bowls used for receiving conventional tubing slips, the bowl of this invention includes a short seating section of sufficient capacity of hold a short tubing string pulled to at least 40,000#. The tubing string is then tensioned to raise the uppermost pin connection above the tubing head flange and a set of short slips is placed in the bowl. The rig travelling block is then lowered and the load of the tubing string is transferred to the trap door bowl and slips of this invention. The pup joint and collar are then removed and the tree attached to the threaded upset end of the uppermost tubing joint. The travelling block is then attached to the tree and the tree raised to transfer the load of the tubing string off the trap door bowl and slips of this invention back to the rig. Because the slips are short, they can be removed from under the flange of the tree assembly. The trap door of the bowl is then opened and the bowl removed laterally off the tubing string. The tree is then lowered and attached to the tubing head flange in a conventional manner. In this fashion, a very shallow well can be completed using a tension held hold down device such as a packer or tubing anchor.

Disclosures of some interest relative to this invention are found in U.S. Pat. Nos. 1,650,074; 1,708,645; 1,986,283; 2,507,246; 2,712,455; 3,330,354 and 4,279,308.

It is an object of this invention to provide an improved method and apparatus for completing shallow wells using a tension held tubing hold down device.

Other objects and advantages of this invention will become more fully apparent as this description proceeds, reference being made to the accompanying drawings and appended claims.

IN THE DRAWINGS:

FIG. 3 is a top plan view of a trap door bowl of this invention showing the bowl in a closed position ready to receive the slips shown in FIG. 4;

FIG. 4 is an exploded view of the trap door bowl of FIG. 3 and a set of slips together comprising the assembly of this invention;

FIG. 5 is a top view of the slips in an open position;

FIG. 6 is a bottom plan view of the trap door bowl of FIG. 3 showing the bowl in the open position;

FIG. 9 is a partial view of another embodiments of the slips of this invention.

Figure 1:
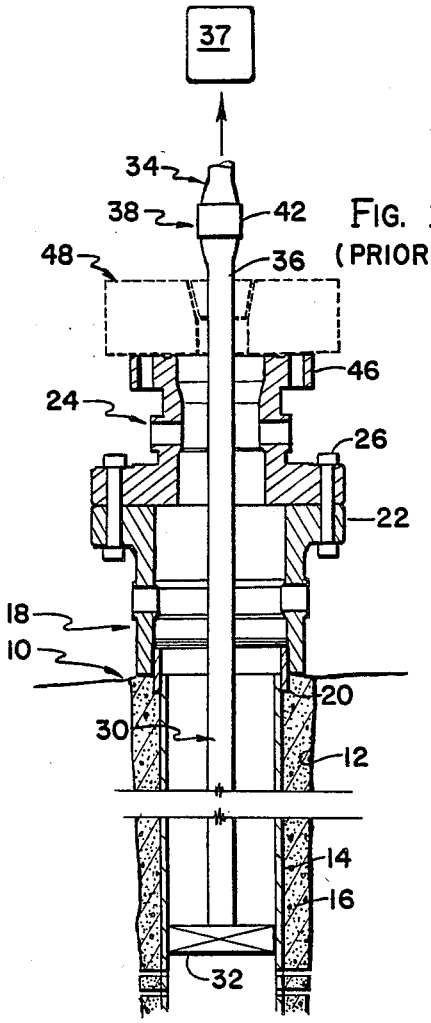
FIG. 1 (PRIOR ART)
FIG. 1 is a partially schematic vertical cross-sectional view of a shallow well in the process of being completed by prior art techniques.

Referring to FIGS. 3–6, the assembly 52 of this invention comprises, as major components, a trap door bowl 54 and a short set of slips 56. The bowl 54 comprises first and second split segments 58, 60 which, when nested together, provide an upwardly facing surface 64 and an annular generally flat bottom face 66 which is supported on the tubing head upper flange 46 as will become more fully apparent hereinafter. The bowl 54 provides a central opening 68 tapered from a larger upper end toward a smaller lower end for receiving the slips 56.

The bowl segment 58 is preferably much larger than the segment 60 for ease of handling. To this end, the bowl segment 58 extends around about 270° of a central or tubing axis 70 while the segment 60 extends around the remaining 90°. The segments 58, 60 are preferably pivotally connected, as by a hinge 72 at one end of the segment 60 and a pin connection 74 at the other end. The hinge and pin connections 72, 74 are essentially identical and comprise a pair of ears 76 on the segment 58 and a single ear 78 on the segment 60. The connections 72, 74 differ because a bolt 79 completes the hinge connection 72 and the pin connection 74 comprises a pin 80 tethered to a chain 82 connected to one of a pair of identical handles 84. As will be evident from FIG. 3, the segments 58, 60 part along a pair of spaced generally vertical parting lines defined by the abutting generally vertical surfaces 86, 88, 90, 92. It will be seen that the trap door segment 60 is mounted for movement in a path coplanar with the segment 58.

Several important aspects of the trap door bowl 54 are illustrated in FIG. 4. First, the bowl 54 has the capability of withstanding substantial loads and transferring those loads to the underlying well head support on which it rests. To this end, the flat annular bottom face 66 is capable of squarely resting on the tubing head upper flange 46. It will be apparent that substantial loads can be transferred from the bottom face 66 to the tubing head 24. Second, the bowl 54 is necessarily weakened because the trap door segment 60 is separate from the segment 58, i.e. the bowl 54 would be stronger if the segments 58, 60 were of one piece. This weakness of the bowl 54 is not completely compensated by the hinge and pin connections 72, 74 because the pins 79, 80 thereof are obviously not as strong as the flange 62 would be if it were of one piece. Analysis of the bowl 54 reveals that the segments 58, 60 would separate under high load if the pins 79, 80 were to fail. To minimize the force tending to separate the segments 58, 60, a downwardly extending annular projection 94 projects below the flange bottom face 66 at a radially inward location therefrom. Thus, when the bowl 54 is placed on the tubing head 24, the flange bottom face 66 rests on the upper flange surface 96 while the annular projection 94 extends into the central passage 98 of the tubing head 24. When a substantial load is applied to the bowl 54, any force tending to separate the segments 58, 60 causes the projection 94 to bear against the inner surface of the passage 98 thereby supporting the segments 58, 60 against such separation.

The slips 56 may be of any conventional type and conveniently comprise three separable segments 100 which, when nested together in an operating position provide a central tubing receiving opening having a multiplicity of gripping teeth 102 for engaging the exterior surface of the tubing string 30 in a manner understood by those skilled in the art. Each of the segments 100 includes a lifting eye 104 providing something to grasp when retrieving the slips 56 from the trap door bowl 54.

One peculiarity of the slips 56 is the segments 100 are connected in such a manner that allows maximum spreading movement therebetween. To this end, the central segment 100 is joined to the outside segments 100 by links 106 pivotally connected by threaded fasteners 108 at each end of the links 106 as shown in FIG. 5.

Figure 7:
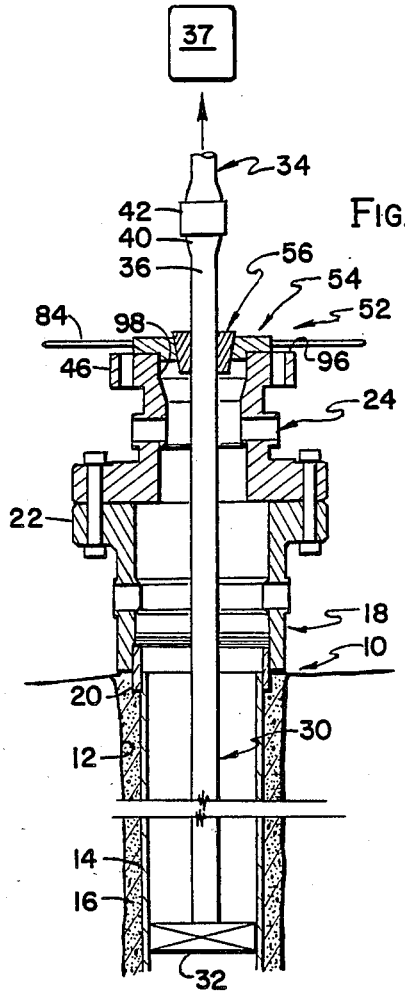
FIG. 7 is a view similar to FIG. 1 illustrating the technique of this invention at a stage analogous to that of FIG. 1.
Figure 2:
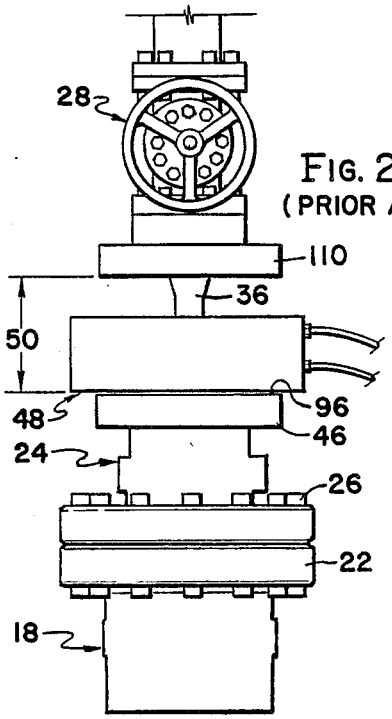
FIG. 2 (PRIOR ART)
FIG. 2 is a view similar to FIG. 1 showing a shallow well somewhat later in the process of being completed by prior art techniques.

Referring to FIG. 7, the technique of this invention is illustrated in conjunction with the well 10. After the tubing head 24 has been attached to the casing head or bradenhead 18, the tubing string 30 is run into the well in a conventional manner by running a first joint or stand of tubing into the hole with the travelling block 37, supporting the tubing string 30 on the tubing head 24 with the hydraulically operated slips 48, detaching the travelling block 37 from the tubing string 30, connecting the travelling block 37 to a second joint or stand of tubing, threading the second joint or stand of tubing into the upwardly facing collar of the tubing string 30 suspended in the slips 48 and then running the second joint or stand of tubing into the well 10. After the tubing string 30 has been run into the well 10 in this fashion and no additional joints or stands of tubing need to be run into the well, the first set of slips 48 is removed from the tubing head 24 in a conventional manner. The packer or tubing anchor 32 is set by pulling upwardly thereon to position the bottom of the upset 40 slightly below the upper flange surface 96.

The trap door of the bowl 54 of this invention is opened by removing the pin 80 from the ears 76, 78 and opening the segment 60 as shown in FIG. 3. The bowl 54 is then moved laterally toward the tubing string 30 so it enters the opening 68. The bowl 54 is placed on the tubing head upper flange 46 and the trap door is closed by repinning the pin connection 74. The bowl 54 is jiggled about to allow the projection 94 to drop into the central opening of the tubing head 24. The travelling block 37 is raised to stretch the tubing string 36 to bring the collar 42 substantially above the top of the tubing head flange 46. The slips 56 are set in the opening 68 and the travelling block 37 lowered to transfer the load of the tubing string 30 to the slips 56, bowl 54 and tubing head 24.

Figure 8:
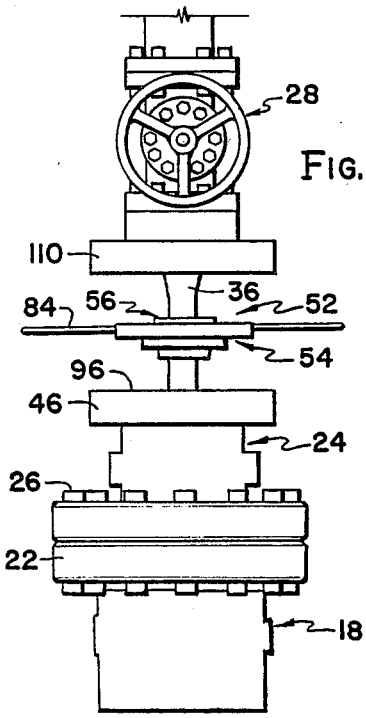
FIG. 8 is a view similar to FIG. 2 illustrating the technique of this invention at a stage analogous to that of FIG. 2.

The pup joint 34 and collar 42 are then removed and the tree 28 attached to the threaded upset end 40 of the uppermost tubing joint 36. The travelling block 37 is then attached to the tree 28 and the tree 28 raised to transfer the load of the tubing string 36 and tree 28 off the trap door bowl 54 and slips 56 of this invention back to the rig as suggested in FIG. 8. Because the slips 56 are short, they can be removed from under the flange 110 of the tree assembly 28. The trap door segment 60 of the bowl 54 is then opened and the bowl 54 removed laterally away the tubing string 30 and off the tubing head 24. The tree 28 is then lowered and attached to the tubing head flange 46 in a conventional manner. It will be appreciated that FIG. 8 is somewhat misleading because the assembly 52 of this invention is illustrated as elevated from the tubing head flange 46 when this does not occur in practice. This partially exploded feature of FIG. 8 is done to illustrate the size of the assembly 52 relative to the tubing head 24 and tree 28.

Because the slips 56 are quite short, a very shallow well can be completed using a tension held hold down device such as the packer or tubing anchor 32. With one embodiment of the assembly 52, in which the flange 62 is about two inches thick and the slips are about six inches tall, including the lifting eyes 104, wells as shallow as 1000′ can be handled easily and wells on the order of 800′ can be completed.

A modification of the slips 56 allows the completion of even shallower wells. As shown in FIG. 9, a set of slips 120 comprises a plurality of slip segments 122 connected together in the same fashion as the slips 56. The slip segments 122 are considerably shorter than the slip segments 98. Indeed, in the embodiment actually built, the slip segments 122 comprise the longer segments 98 which were shorter in a machine shop. An eye 124 which is considerably shorter than the eye 104 connects to a looped cable 126 secured to a tee handle 128. The cable 126 is sufficiently long to place the handle 128 outside the flanges 46, 110 shown in FIG. 8. Because the slip segments 98 are shorter, the height of the assembly 52 is shortened. In addition, the eye 124, cable 126 and handle 128 shorten the required vertical space between the flanges 46, 110 to allow the slips 120 to be set and retrieved during the completion of the well 10. It is believed that wells no deeper than 500′ can be completed with a tension held packer by the use of this invention.

In contrast, prior art hydraulically operated slips 48 vary somewhat in height, but are considerably taller than the assembly 52 of this invention and usually are on the order of about 18″ high. Such prior art slips cannot usually complete a well shallower than 2000′ with a tension held hold down device 32.

Although this invention has been disclosed and described in its preferred form with a certain degree of particularity, it is understood that the present disclosure of the preferred form is only by way of example and that numerous changes in the details of operation and in the combination and arrangement of parts may be resorted to without departing from the spirit and scope of the invention as hereinafter claimed.

I claim:

1. A method of completing a well having a casing string extending into the earth and a well head assembly attached to the casing string and providing a support, comprising the steps of running a tubing string less than 2000′ long into the well having a tension held hold down device thereon by periodically supporting the tubing string on the well head support with a first set of fluid actuated slips;

removing the first set of fluid actuated slips from the well head assembly while the tubing string is supported from a travelling block of a rig;

moving a bowl laterally of the tubing string to a position surrounding the tubing string and supporting the bowl on the well head support;

pulling upwardly on and stretching the tubing string with the travelling block; then placing a second set of slips in the bowl, gripping the tubing string with the second set of slips, lowering the travelling block and transferring the weight of the tubing string through the second set of slips and bowl to the well head support; then detaching the travelling block from the tubing string, attaching a Christmas tree to the tubing string, attaching the travelling block to the Christmas tree and pulling upwardly thereon for transferring the weight of the tubing string to the travelling body; then removing the second set of slips from the bowl and away from the tubing string; then removing the bowl from the position surrounding the tubing string in a direction laterally of the tubing string; then lowering the Christmas tree to adjacent the well head support and coupling the Christmas tree to the well head.

2. A method of completing a well by the use of a rig having a travelling block, the well having a casing string extending into the earth, a well head assembly attached to the casing string and including a support, a tubing string extending into the casing string and a tension held hold down device on the tubing string set in the casing string, comprising the steps of running less than about 2000′ of the tubing string into the well and periodically supporting the tubing string on the support with a first set of slips;

removing the first set of slips;

pulling upwardly on the tubing string with the travelling block and setting the hold down device; then transferring the weight of the tubing string to the well head assembly including moving a bowl laterally of the tubing string into a position surrounding the tubing string and supporting the bowl on the support, placing a second set of tubing slips in the bowl, and lowering the travelling block and transferring the weight of the tubing string through the second slips and bowl to the well head support; then attaching a Christmas tree to the tubing string; then attaching the Christmas tree to the well head assembly including removing the weight of the tubing string from the second slips and bowl, removing the second slips vertically from the bowl and moving the second slips away from the tubing string, and then removing the bowl from the position surrounding the tubing string in a direction laterally of the tubing string.

3. The method of claim 2 wherein the bowl comprises a relatively stationary segment defining a plane, a trap door segment and means mounting the trap door segment on the stationary segment for movement in a path including the plane of the stationary segment, the bowl removing step comprising moving the trap door segment away from the tubing string in the path defined by the plane of the stationary segment while leaving the stationary segment in place to provide a path of movement for the tubing string and then moving the tubing string through the path of movement.

4. The method of claim 2 wherein the casing support comprises a tubing head providing a central opening therethrough and the bowl comprises a downwardly facing projection sized to be received in the tubing head central opening, wherein the step of supporting the bowl on the support comprises placing the projection in the tubing head central opening and supporting the bowl against lateral movement away from the tubing head.

5. A combination bowl-slips assembly, comprising:

a trap door bowl including an annular flange having a single substantially central opening therethrough tapering from a large upper end toward a small lower end and providing a flat annular bottom face for support on an upwardly facing flange of a well head support and an annular projection, surrounding the flange opening, radially inwardly of the flat bottom face and extending downwardly therefrom for receipt in a central opening of the well head support, the tapering of the central opening extending into the projection, the flange comprising a first major segment defining an arc substantially greater than 180° and a second minor segment defining an arc substantially less than 180° separated along first and second spaced upright parting lines, and means mounting the second segment in a path of movement on the first segment between a first closed position providing a slips support and a second open position spaced from the first segment providing an opening in the major flange segment providing a path for moving the major flange segment radially toward and away from a tubing string for positioning the trap door bowl about the tubing string, the mounting means comprising a first pin perpendicular to the path of movement connecting a first end of the second segment to the first segment; and means securing the first and second segments together including a second pin perpendicular to the path of movement connecting a second end of the second segment to the first segment; and a set of slips, received in the bowl opening, including a plurality of downwardly tapering slip segments providing a central slip opening therebetween providing an axis, a downwardly tapered outer surface engaging the tapered bowl opening and a multiplicity of teeth for gripping the tubing string;

the slips being separable from the bowl and from the bowl opening.

6. The bowl-slips assembly of claim 5 further comprising a pair of opposed handles secured to the first major flange segment and extending away from opposite sides thereof.

7. The bowl-slips assembly of claim 5 further comprising means pivotally connecting the slip segments together including first and second links, the first link being pivotally connected at a first end to one slip segment and pivotally connected at a second end to a second slip segment and the second link being pivotally connected at a first end to the second slip segment and pivotally connected at a second end to a third slip segment.

8. The bowl-slips assembly of claim 5 wherein the first flange segment extends about 270° about the tubing string and the second flange segment extends about 90° about the tubing string.

9. The bowl-slips assembly of claim 5 wherein the bowl is not substantially taller than 2" and the slips are not substantially taller than 6", both dimensions being measured parallel to the axis.

10. The bowl-slips assembly of claim 5 further comprising means for lifting the slips out of the bowl including an eye secured to at least two of the slip segments.

11. The bowl-slips assembly of claim 10 wherein the lifting means further comprises a cable, secured to the eyes, extending substantially away from the slip segments.

12. An assembly comprising a well including a casing string extending into the earth, a wall head attached to the casing string and providing an annular upwardly facing flange having an opening therethrough, a tubing support having a lower annular flange bolted to the well head flange and an upper annular upwardly facing flange providing an opening communicating with the well head opening, a tension held tubing hold down device inside the casing string, a tubing string connected to the hold down device and extending upwardly through the well to a location above the upper support flange, the improvement comprising a combination bowl-slips assembly comprising a trap door bowl including an annular flange having a single substantially central opening therethrough tapering from a large upper end toward a small lower end and providing a flat annular bottom face supported on the upper upwardly facing support flange and a projection radially inwardly of the flat bottom face and extending downwardly therefrom into the opening of the support, the support opening substantially preventing lateral movement of the projection relative to the support, the flange comprising first and second segments separated along first and second spaced upright parting lines for providing a path for moving the flange radially toward and away from a tubing string for positioning the trap door bowl about the tubing string, and means securing the first and second segments together; and a set of slips, received in the bowl opening, including a plurality of downwardly tapering slip segments providing a central slip opening therebetween defining an axis, a downwardly tapered outer surface engaging the tapered bowl opening and a multiplicity of teeth for gripping the tubing string, the slips being separable from the bowl and from the bowl opening.

13. The assembly of claim 12 wherein the bowl-slips assembly further comprises means pivotally connecting the slip segments together including first and second links, the first link being pivotally connected at a first end to one slip segment and pivotally connected at a second end to a second slip segment and the second link being pivotally connected at a first end to the second slip segment and pivotally connected at a second end to a third slip segment.

14. The assembly of claim 12 wherein the first flange segment extends through an arc substantially greater than 180° about the tubing string and the second flange segment extends through an arc substantially less than 180° about the tubing string.

15. The assembly of claim 14 wherein the bowl-slips assembly further comprises a pair of opposed handles secured to the first flange segment and extending away from opposite sides thereof.

16. The assembly of claim 14 wherein the means connecting the first and second flange segments together comprises means pivotally connecting a first end of the second segment to the first segment and means pinning a second end of the second segment to the first segment.

17. The assembly of claim 12 wherein the bowl is not substantially taller than 2" and the slips are not substantially taller than 6", both dimensions being measured parallel to the axis.

18. The assembly of claim 12 wherein the bowl segments define a plane and further comprising means mounting the segments for relative movement in a path including the plane.

19. The assembly of claim 12 wherein the well comprises a Christmas tree, the tubing having insufficient stretch to receive a second set of slips between the upper annular flange and the Christmas tree and wherein the first mentioned set of slips is shorter than the second set of slips.

20. A method of working on a well having a casing strip extending into the earth, a tubing string therein, a tension held hold down device securing a lower end of the tubing string inside the casing string, a well head assembly attached to the casing string and providing a support and a Christmas tree for sealing between the tubing string and the well head assembly, there being insufficient stretch in the tubing string to allow movement of a first set of slips between the support and the Christmas tree, comprising the steps of pulling upwardly on and stretching the tubing string with a travelling block of a rig;

moving a first segment of a bowl laterally of the tubing string to a position adjacent the tubing string, moving a second segment of the bowl laterally of the tubing string independently of the first bowl segment to a position where the first and second bowl segments surround the tubing string, connecting the first and second bowl segments together and supporting the connected bowl segments on the well head support;

placing the connected bowl segments a second set of slips, shorter than the first set of slips, gripping the tubing string with the second set of slips, lowering the travelling block and transferring the weight of the tubing string and Christmas tree through the second set of slips and connected bowl segments to the well head support; and removing the second set of slips by again pulling upwardly on and stretching the tubing string with the travelling block of the rig, disconnecting the first and second bowl segments and moving the first and second bowl segments laterally of the tubing string.

* * * * *